US007631669B2

(12) United States Patent
Rougvie et al.

(10) Patent No.: US 7,631,669 B2
(45) Date of Patent: Dec. 15, 2009

(54) MONOFILAMENTS TO OFFSET CURL IN WARP BOUND FORMING FABRICS

(75) Inventors: David S. Rougvie, Appleton, WI (US); Hayward Bradford Arthur, Lafayette, NY (US); Louis Jay Jandris, Lafayette, NY (US); Manish Jain, Homer, NY (US)

(73) Assignee: Albany International Corp., Albany, NY (US)

( * ) Notice: Subject to any disclaimer, the term of this patent is extended or adjusted under 35 U.S.C. 154(b) by 145 days.

(21) Appl. No.: 11/439,676

(22) Filed: May 24, 2006

(65) Prior Publication Data

US 2007/0000553 A1 Jan. 4, 2007

Related U.S. Application Data

(60) Provisional application No. 60/684,786, filed on May 25, 2005, provisional application No. 60/683,955, filed on May 24, 2005.

(51) Int. Cl.

| | |
|---|---|
| ***D21F 1/10*** | (2006.01) |
| ***D21F 7/08*** | (2006.01) |
| ***D03D 3/04*** | (2006.01) |
| *D03D 25/00* | (2006.01) |

(52) U.S. Cl. ..... 139/383 A; 139/383 R; 162/358.2

(58) Field of Classification Search ..... 139/383 A; 162/348, 349, 358.2, 902

See application file for complete search history.

(56) References Cited

U.S. PATENT DOCUMENTS 4,351,874 A * 9/1982 Kirby ..... 442/195
4,356,844 A * 11/1982 Thompson ..... 139/383 A
4,388,364 A * 6/1983 Sanders ..... 442/313
4,453,573 A * 6/1984 Thompson ..... 139/383 A
4,621,020 A 11/1986 Tashiro et al. ..... 428/361
4,973,512 A 11/1990 Stanley et al. ..... 428/229
5,023,132 A * 6/1991 Stanley et al. ..... 442/195
5,094,719 A * 3/1992 Fry ..... 162/358.2
5,169,711 A * 12/1992 Bhatt et al. ..... 442/199
5,244,543 A * 9/1993 Fry ..... 162/358.2
5,324,392 A 6/1994 Tate et al. ..... 162/348
5,360,660 A * 11/1994 Nohlgren ..... 442/207
5,407,736 A * 4/1995 McKeon ..... 442/199
5,617,903 A * 4/1997 Bowen, Jr. ..... 139/383 A
5,776,313 A * 7/1998 Bakis et al. ..... 162/358.2
6,123,116 A * 9/2000 Ward et al. ..... 139/383 A
6,132,872 A * 10/2000 McIntosh et al. ..... 428/398
6,319,606 B1 * 11/2001 Best ..... 428/395

(Continued)

FOREIGN PATENT DOCUMENTS

JP 2000-170034 6/2000

*Primary Examiner*—Bobby H Muromoto, Jr.
(74) *Attorney, Agent, or Firm*—Frommer Lawrence & Haug LLP; Ronald R. Santucci

(57) ABSTRACT

A papermaking fabric having a top layer and a bottom layer of interwoven machine direction (MD) yarns and cross-machine direction (CD) yarns bound together with warp binder yarns. At least some of the CD yarns are made of a material which generates a strong contractive force when returned to room temperature after heat-setting (annealing under MD tension). These CD yarns are positioned such that the strong contractive force offsets tension forces generated when the fabric is placed under load and which typically result in an edge curl. An exemplary material for these CD yarns is polybutylene terephthalate (PBT).

14 Claims, 2 Drawing Sheets

U.S. PATENT DOCUMENTS

| | | | | |
|---|---|---|---|---|
| 6,462,145 | B1 | 10/2002 | Fleri et al. | 525/444 |
| 6,511,582 | B2 | 1/2003 | Westerkamp | 162/348 |
| 6,589,392 | B1 * | 7/2003 | Skinner et al. | 162/348 |
| 6,670,034 | B2 * | 12/2003 | Boyd et al. | 428/370 |
| 6,828,261 | B2 * | 12/2004 | Soelch et al. | 442/199 |
| 2003/0157322 | A1 * | 8/2003 | Boyd et al. | 428/373 |
| 2004/0014386 | A1 * | 1/2004 | Soelch et al. | 442/199 |
| 2004/0094281 | A1 * | 5/2004 | Hansen | 162/358.1 |
| 2004/0168737 | A1 * | 9/2004 | Zils | 139/383 A |
| 2004/0206414 | A1 * | 10/2004 | Festor | 139/383 A |
| 2004/0221914 | A1 * | 11/2004 | Martin | 139/383 A |
| 2004/0261884 | A1 * | 12/2004 | Rydin | 139/383 A |
| 2005/0017402 | A1 * | 1/2005 | Boyd et al. | 264/211.22 |
| 2005/0252566 | A1 * | 11/2005 | Kornett et al. | 139/383 AA |
| 2005/0252567 | A1 * | 11/2005 | Yook et al. | 139/383 AA |
| 2006/0081349 | A1 * | 4/2006 | Bakken et al. | 162/348 |

* cited by examiner

MONOFILAMENTS TO OFFSET CURL IN WARP BOUND FORMING FABRICS

CROSS-REFERENCE TO RELATED APPLICATIONS

This application claims priority benefits of U.S. Provisional Patent Application Ser. No. 60/683,955 filed May 24, 2005 entitled "Monofilaments to Offset Curl in Warp Bound Forming Fabrics" and U.S. Provisional Patent Application Ser. No. 60/684,786 filed May 25, 2005 entitled "Monofilaments to Offset Curl in Warp Bound Forming Fabrics", the disclosures of which are incorporated herein by reference.

BACKGROUND OF THE INVENTION

1. Field of the Invention

The present invention relates to the papermaking arts. More specifically, the present invention relates to forming fabrics for a forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in a forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface properties, but such design may lack the desired stability resulting in a short fabric life. By contrast, coarse mesh fabrics provide stability and long life at the expense of fiber support. To minimize the design tradeoff and optimize both support and stability, multi-layer fabrics were developed. For example, in double and triple layer fabrics, the forming side is designed for support while the wear side is designed for stability, as well as drainage.

Essentially, multi-layer fabrics consist of two fabrics, the forming layer and the wear layer, held together by binding yarns. The binding is extremely important to the overall integrity of the fabric. One problem with multi-layer fabrics has been that the binding yarns tend to alter the contractive properties of the base fabric layers when the fabrics are placed under tension. As a result, such fabrics often exhibit an upwards curling along the edges when in use on a papermaking machine. This edge curl effect is particularly noticeable in warp bound fabrics where the yarns binding the fabric layers run in the machine direction (MD). Parameters which impact this curling effect include the fabric's layer construction, weave pattern, yarn materials and sizes, and any finishing processing performed on the fabric. Various fabrics have been designed to limit edge curl by controlling these parameters, but with limited success. Most commonly, attempts have been made to control edge curl through the heat-setting and stress treatments applied as part of the finishing process. However, these treatments are difficult to control and are often not permanent. Moreover, these treatments leave a characteristic out-of-plane bulge between the edge and the body of the fabric.

The present invention provides a solution to this problem of edge curl in warp bound forming fabrics. The present invention describes a multi-layer fabric having cross-machine direction (CD) yarns made of materials which counter the edge curl effect when placed under load.

SUMMARY OF THE INVENTION

Accordingly, the present invention relates to a forming fabric for use in the forming section of a paper machine, although it may find application in the pressing and/or drying sections of the paper machine.

The present fabric is a papermaking fabric having a top layer and a bottom layer of interwoven machine direction (MD) yarns and cross-machine direction (CD) yarns bound together with warp binder yarns. At least some of the CD yarns are made of a material which generates a strong contractive force when returned to room temperature after heat-setting. These CD yarns are positioned in the fabric such that the strong contractive force offsets tension forces generated when the fabric is placed under load and which typically result in an edge curl. An exemplary material for these CD yarns is polybutylene terephthalate (PBT).

In a preferred embodiment, the fabric is a triple layer forming fabric where the top layer is the forming side of the fabric and the bottom layer is the wear side of the fabric.

Other aspects of the present invention include that at least some of the yarns may be one of polyamide yarns or polyester yarns, some of the yarns may be monofilament yarns, and some of the yarns may have different diameters and/or shapes.

The present invention will now be described in more complete detail with frequent reference being made to the drawing figure, which is identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

As discussed above, multi-layer papermaking fabrics that contain machine direction oriented yarns to connect the layers tend to run with the edges curling strongly upwards when on the paper machine. This is because the warp binder yarns impart different contractive properties to the separate layers when under tension. As a result, the edges of the fabric curl upwards when the fabric is placed under load. Fabrics that are optimized for all other properties but still exhibit this edge curl when under load are not accepted by the market. Accordingly, there is a need to provide a permanent, opposing effect to control curl in this class of fabrics. The present invention strategically incorporates different yarns materials having characteristics that can be used to counter the tension forces which cause edge curl in these fabrics.

The present invention is intended to encompass both warp bound fabrics and multi-layer fabrics bound with additional MD binder yarns. In a warp bound fabric, some of the MD yarns, which may be intrinsic to one or both layers, cross between layers to at least bind with the other layer. These warp binder yarns are often paired such that the two yarns combine to produce a complete weave pattern (e.g. plain weave pattern, etc.) in one or both of the layers.

A preferred embodiment of the present invention is a papermaking fabric which incorporates CD yarns made of materials, such as polybutylene terephthalate (PBT), which when annealed under tension generate a strong contractive force when returned to room temperature. By properly positioning these different material yarns in the fabric, their strong contractive forces can be used to offset the tension forces which cause edge curling when the fabric is placed under load.

Figure 1:
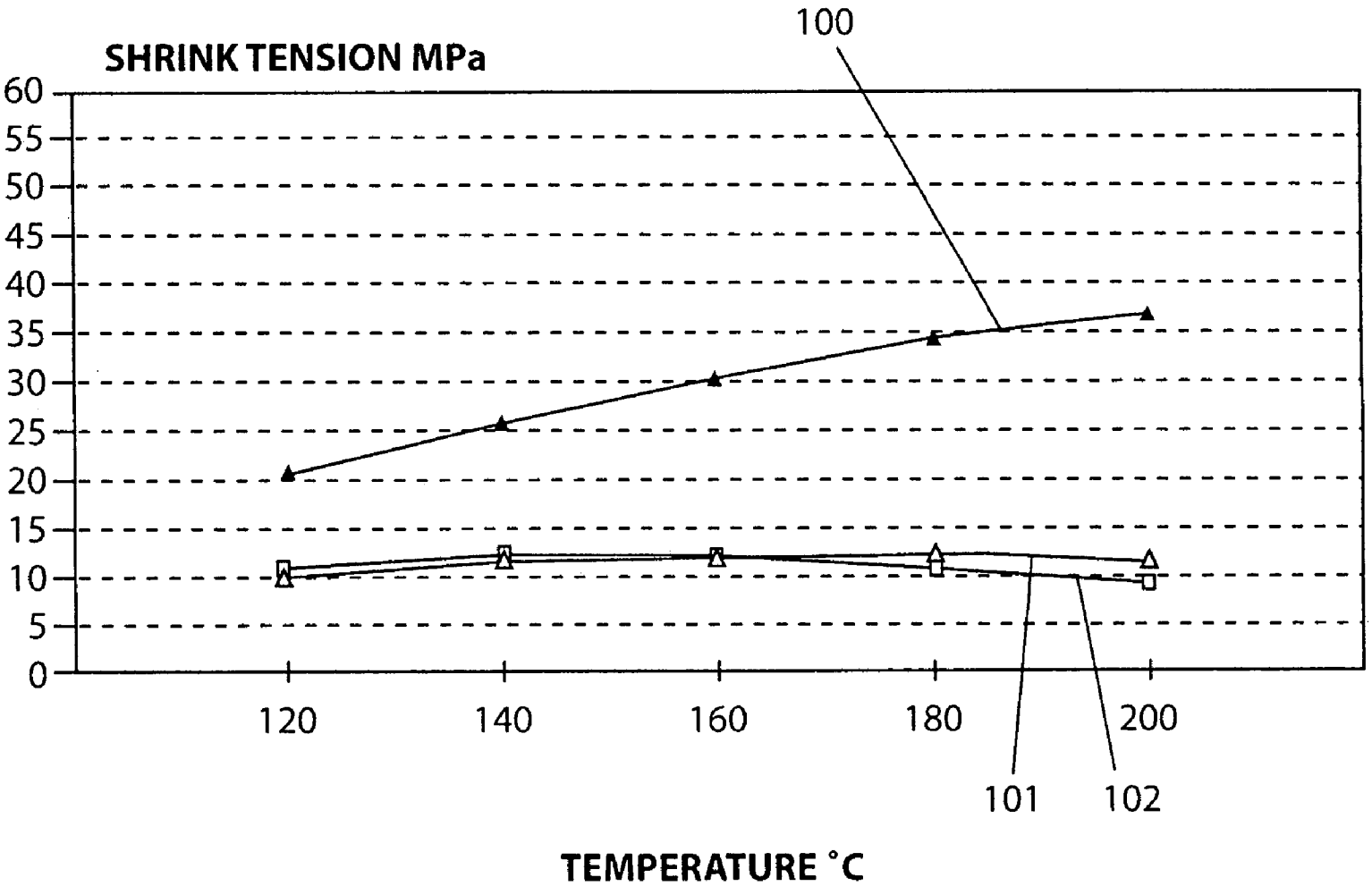
FIG. 1 is a graph showing the shrink tension of PBT (polybutylene terephthalate) at the beginning and end of heat treatment over a range of temperatures and at room temperatures following treatment.
Figure 2:
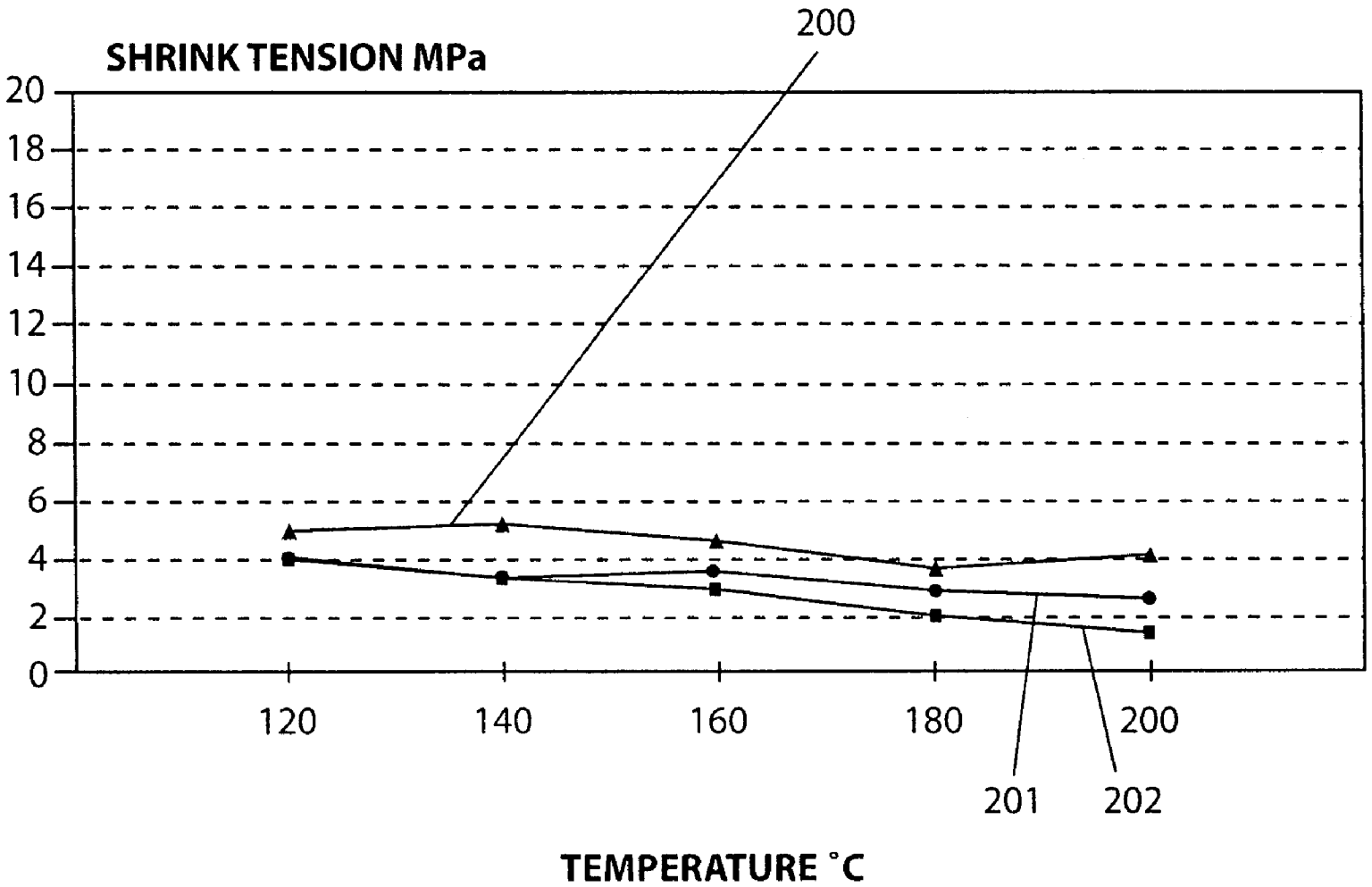
FIG. 2 is a graph showing the shrink tension of PET (polyethylene terephthalate) at the beginning and end of heat treatment over a range of temperatures and at room temperatures following treatment.

Accordingly, desirable materials for use in the present invention should exhibit a strong contractive force when returned to room temperature after heat-setting (annealing under MD tension). An exemplary material exhibiting this characteristics is PBT. FIG. 1 is a graph showing the shrink tension of PBT (polybutylene terephthalate) at the beginning 101 and end 102 of heat treatment over a range of temperatures and at room temperatures following treatment 100. The shrink tension is a measure of the contractive force of the material. For comparison, FIG. 2 shows the shrink tension of PET (polyethylene terephthalate) at the beginning 201 and end 202 of heat treatment over a range of temperatures and at room temperatures following treatment 200. Note that following treatment, the PET material has a low shrink tension whereas the PBT material has a significantly higher shrink tension. A PBT yarn, like Teijin 936B (the material shown in FIG. 1), when annealed under tension, generates a strong shrinkage force when the annealing heat is removed. This force causes the PBT yarn to contract, imparting a strong curl into any fabric it is woven into. For this reason, prior art papermaking fabrics do not typically use PBT as a yarn material.

However, by strategically positioning PBT yarns in a fabric, the present invention uses this contractive force to oppose the natural edge curl under tension seen in warp bound structures. Such PBT yarns, when incorporated as some or more of the CD yarns, impart a balancing curl to the freed edges of the fabric. Preferably the PBT yarns are used as CD yarns, however different materials may be used for any of the yarns which comprise the fabric.

Another aspect of the invention is that different material yarns can be blended with other yarns and yarns materials to control the offset effect. For example, if the countering forces generated by the PBT yarns are too strong, the offset effect can be moderated by alternating PBT yarns with standard material yarns, like polyethylene terephthalate (PET) or a polyamide (PA). These different material yarns may be alternated at various ratios; such as 1 PBT:1 PA, 1 PBT:3 PA, 1PBT:1PET:1PA, 1 PBT:1PET:2PA, woven as PBT:PA:PET:PA, 2 PBT:3 PA, etc. The effects of PBT may also be moderated by co-polymerizing or blending other materials into the yarn. For example, PET is a suitable/compatible blend with PBT. Since, PBT also has better wear resistance than PET, the yarns formed by combining these two materials will have increased wear resistance and thus the fabric produced using these yarns will have better wear resistance in addition to its edge curl resistance. Blends of 85% PBT and 15% PET respectively by weight should give reduced shrinkage force upon cooling, but still generate enough force to avoid edge curling of the fabric. Blends containing 20% or more PET by weight should not cause fabrics to curl, but still retain a high level of the improved abrasion resistance of the PBT. In this regard, other possible blends of 60% to 90% PBT and of 10% to 40% PET by weight are envisioned. Furthermore, the combination of PBT and PET should not lead to fibrillation and high pressure shower resistance problems that are often seen in other polymer blend monofilaments.

Monofilaments produced from blends of PET or PBT with elastomers for use in improving fabric abrasion resistance are very soft and are badly deformed during heatsetting of fabrics, causing unwanted loss of fabric permeability. They also have poor high pressure shower resistance. The PBT/PET monofilaments of the present invention should not flatten to the same extent. Polyamide monofilaments used in paper machine clothing are susceptible to chemical attack and increase paper machine drive loads. However, this is not the case in a fabric containing the PBT/PET monofilaments of the present invention and there should be no loss in fabric abrasion resistance in the case of fabrics containing alternating PET/PBT and alternating PET/(PBT/PET 85/15 blends respectively by weight). The abrasion resistance of fabrics of alternating PET/PA when compared to that of 100% PET fabrics should be better. Blends of PBT/PET with low shrinkage effects may be used 100% on the wear-side of fabrics, which may match or exceed the performance of alternating PET/PA. Other materials could also be blended with PBT to produce a desirable shrinkage behavior.

The fabrics according to the present invention preferably comprise only monofilament yarns. Additionally, the CD yarns and MD yarns in the forming side and wear side may have different diameters. It is preferable for the forming side CD and MD yarns to have smaller diameters than the wear side CD and MD yarns. However, various combinations of yarn diameters can be used in the present invention. Further, in addition to a circular cross-sectional shape, one or more of the yarns may have other cross-sectional shapes such as a rectangular cross-sectional shape or a non-round cross-sectional shape. As discussed above, any suitable combination of materials may be used as identified by one of ordinary skill in the art. Also, the location of such CD yarns in the fabric, such as wear side, forming side, either or both, may vary depending upon the application. Note, these examples are simply representative examples of the invention and are not meant to limit the invention.

Modifications to the above would be obvious to those of ordinary skill in the art, but would not bring the invention so modified beyond the scope of the present invention. The claims to follow should be construed to cover such situations.

We claim:

1. A multilayer warp bound paper machine clothing or fabric with resistance to edge curling, said paper machine clothing comprising:

a system of machine-direction (MD) yarns and a system of cross-machine direction (CD) yarns, said yarns of said system of MD yarns being interwoven with said yarns of said system of CD yarns to form said paper machine clothing, at least some of said MD yarns being used as binding yarns to connect the layers of the paper machine clothing, wherein said system of CD yarns comprises a plurality of CD yarns being made of a material which counters edge curling when the paper machine clothing is placed under load and said plurality of CD yarns are positioned in the fabric such that a strong contractive force offsets tension forces generated when the fabric is placed under load and which typically result in an edge curl, wherein said plurality of CD yarns comprise yarns made of a copolymer blend of polybutylene terephthalate (PBT) and polyethylene terephthalate (PET) in the amounts of 60%-90% and 10%-40% respectively by weight.

2. The paper machine clothing according to claim 1, wherein said plurality of CD yarns are made of polybutylene terephthalate (PBT) and polyethylene terephthalate (PET) in the amounts of approximately 80%-85% and 15%-20% respectively by weight.

3. The paper machine clothing according to claim 1, wherein said yarns of said system of MD yarns and said yarns of said system of CD yarns are monofilaments.

4. The paper machine clothing according to claim 1, wherein said paper machine clothing has a surface side and a machine side.

5. The paper machine clothing according to claim 4, wherein said CD yarns and said MD yarns on the surface side and machine side have different diameters.

6. The paper machine clothing according to claim 4, wherein said CD yarns and said MD yarns on the surface side have smaller diameters than said CD yarns and said MD yarns on the machine side.

7. The paper machine clothing according to claim 1, wherein at least one of said CD yarns and said MD yarns has a non-round cross-sectional shape.

8. The method of forming a multilayer warp bound paper machine clothing with resistance to edge curling, said method comprising the steps of:

providing a system of machine-direction (MD) yarns and a system of cross-machine direction (CD) yarns, said yarns of said system of MD yarns being interwoven with said yarns of said system of CD yarns to form said paper machine clothing, at least some of said MD yarns being used as binding yarns to connect the layers of the paper machine clothing, wherein said system of CD yarns comprises a plurality of CD yarns being made of a material which counters edge curling when the paper machine clothing is placed under load, and said plurality of CD yarns are positioned in the fabric such that a strong contractive force offsets tension forces generated when the fabric is placed under load and which typically result in an edge curl, and wherein said plurality of CD yarns comprise yarns made of a copolymer blend of polybutylene terephthalate (PBT) and polyethylene terephthalate (PET) in the amounts of 60%-90% and 10%-40% respectively by weight.

9. The method according to claim 8, wherein said plurality of CD yarns are made of polybutylene terephthalate (PBT) and polyethylene terephthalate (PET) in the amounts of approximately 80%-85% and 15%-20% respectively by weight.

10. The method according to claim 8, wherein said yarns of said system of MD yarns and said yarns of said system of CD yarns are monofilaments.

11. The method according to claim 8, wherein said paper machine clothing has a surface side and a machine side.

12. The method according to claim 11, wherein said CD yarns and said MD yarns on the surface side and machine side have different diameters.

13. The method according to claim 11, wherein said CD yarns and said MD yarns on the surface side have smaller diameters than said CD yarns and said MD yarns on the machine side.

14. The method according to claim 8, wherein at least one of said CD yarns and said MD yarns has a non-round cross-sectional shape.

* * * * *

UNITED STATES PATENT AND TRADEMARK OFFICE

CERTIFICATE OF CORRECTION

PATENT NO. : 7,631,669 B2
APPLICATION NO. : 11/439676
DATED : December 15, 2009
INVENTOR(S) : Rougvie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 209 days.

Signed and Sealed this

Twenty-first Day of December, 2010

David J. Kappos

David J. Kappos
*Director of the United States Patent and Trademark Office*